US010247371B2

(12) United States Patent
Feldman

(10) Patent No.: US 10,247,371 B2
(45) Date of Patent: Apr. 2, 2019

(54) DEVICE, METHOD, AND A KIT FOR RETROFITTING A TRIMMED RECESSED LIGHT FIXTURE FOR INSTALLATION OF A TRIMLESS RECESSED LIGHT FIXTURE

(71) Applicant: JUNA CONSTRUCTION, INC., Brooklyn, NY (US)

(72) Inventor: Nathan Feldman, Brooklyn, NY (US)

(73) Assignee: JUNA CONSTRUCTION, INC., Brooklyn, NY (US)

( * ) Notice: Subject to any disclaimer, the term of this patent is extended or adjusted under 35 U.S.C. 154(b) by 99 days.

(21) Appl. No.: 15/398,183

(22) Filed: Jan. 4, 2017

(65) Prior Publication Data

US 2017/0314750 A1 Nov. 2, 2017

Related U.S. Application Data

(60) Provisional application No. 62/328,816, filed on Apr. 28, 2016.

(51) Int. Cl.

| | |
|---|---|
| ***F21S 8/02*** | (2006.01) |
| ***F21V 17/16*** | (2006.01) |
| *F21V 21/04* | (2006.01) |

(52) U.S. Cl.

CPC ..... *F21S 8/026* (2013.01); *F21V 17/162* (2013.01); *F21S 8/02* (2013.01); *F21V 21/048* (2013.01)

(58) Field of Classification Search

CPC .. F21S 8/02; F21S 8/026; F21V 17/16; F21V 21/04; F21V 21/088

See application file for complete search history.

(56) References Cited

U.S. PATENT DOCUMENTS

| | | | | |
|---|---|---|---|---|
| 6,474,846 | B1 * | 11/2002 | Kelmelis | F21V 17/164 248/231.91 |
| 6,957,896 | B2 * | 10/2005 | Burgess | F21V 21/04 362/147 |
| 8,511,867 | B1 * | 8/2013 | Tam | F21S 8/026 362/147 |
| 2013/0322091 | A1 * | 12/2013 | Honeycutt | F21S 8/026 362/319 |
| 2014/0254177 | A1 * | 9/2014 | Danesh | F21V 21/30 362/363 |
| 2015/0241038 | A1 * | 8/2015 | Fryzek | F21V 21/047 362/147 |

* cited by examiner

*Primary Examiner* — Zheng Song

(74) *Attorney, Agent, or Firm* — Andrew F. Young, Esq.; Lackenbach Siegel, LLP

(57) ABSTRACT

A device for retrofitting an existing trimmed recessed lighting fixture for installation of a trimless recessed light fixture may include a collar section configured to be received within an opening of a housing of the existing trimmed recessed lighting fixture installed above a ceiling surface, the collar section including a proximal section configured to be fitted within the opening of the housing; a surface being secured the collar section, the surface being configured to lie flush against the ceiling and to be joined integrally to the ceiling; and a baffle being releasably lockable to the collar section. A kit including the device and a method of retrofitting an existing trimmed recessed lighting fixture are also disclosed.

9 Claims, 10 Drawing Sheets

DEVICE, METHOD, AND A KIT FOR RETROFITTING A TRIMMED RECESSED LIGHT FIXTURE FOR INSTALLATION OF A TRIMLESS RECESSED LIGHT FIXTURE

CROSS REFERENCE TO RELATED APPLICATIONS

This application claims the benefit of and priority to U.S. Prov. Pat. App. Ser. No. 62/328,816, filed Apr. 28, 2016.

BACKGROUND

Technical Field

The present disclosure relates generally to a trimless recessed lighting device that is configured to fit within and work in conjunction with a standard recessed retrofit or new construction housing. In particular, an apparatus for retrofitting an existing trimmed recessed light fixture to be a trimless recessed light fixture installed in a ceiling is disclosed.

Description of the Related Art

Recessed light features are fixtures that are designed to be visually unobtrusive since very little of the light fixture is visible from below the ceiling. An opening that is cut in the ceiling receives most of the light fixture for mounting above the ceiling resulting in most of the light fixture being above the ceiling. A trim ring is generally located at the opening to conceal the hole that was cut into the ceiling. For example, a prior art light fixture is shown in FIG. 1 in which a recessed light fixture LF is installed above a ceiling surface C. The light fixture LF may include a recessed area in which a light bulb LB is received, and may include an inner ring IR at the open end of the recessed area. A trim ring OR may be secured to at least one of the inner ring IR or the ceiling C to conceal the opening that was cut into the ceiling C. The trim ring OR rests above the ceiling surface and is configured to hide any gap that may exist between the light fixture and the opening in which it is placed within the ceiling.

Conventional so-called trimless recessed lighting is expensive and is only available with an integrated light source. In other words, conventionally, a recessed lighting fixture that includes a trim cannot be retrofitted to be trimless. Rather, if a user desires a trimless lighting fixture, the entire fixture must be replaced. For example, as shown in FIG. 2, a ceiling including an opening in which a receptacle portion R of a light fixture is installed is configured to receive a trimless light 20 that includes a border 22 surrounding the light (e.g., bulb or LED) that is configured to be received within the receptacle portion R and has fastening members 24 that engage the receptacle portion R such that when placed within the opening O the border 22 is flush relative to the ceiling C. Conventional trimless fixtures require exacting measurements because the border 22, which is of a unitary assembly with respect to the rest of the trimless light 20, must be dimensioned to approximate the dimensions of the opening O such that the light 20 is received snuggly within the opening O.

New and improved recessed lighting devices that can work with existing fixtures would be desirable as it would provide a cost effective solution for homeowners that may have recessed lights including a trim.

SUMMARY

Disclosed herein is a trimless recessed lighting system, as well as devices, methods, and kits that convert a trimmed recessed lighting fixture to appear as a trimless lighting fixture without necessitating a reinstallation of an already installed housing that was previously configured or intended to have a trim.

A lighting fixture in accordance with the present disclosure may include a collar section configured to be received within an opening of a housing of the existing trimmed recessed lighting fixture installed above a ceiling surface, the collar section including a proximal section configured to be fitted within the opening of the housing; a surface being secured the collar section, the surface being configured to lie flush against the ceiling and to be joined integrally to the ceiling; and a baffle being releasably lockable to the collar section.

A method for retrofitting an existing trimmed light fixture including a housing mounted above a ceiling surface may include frictionally fitting a collar section within an opening of the housing, securing a surface to the collar section, fitting a baffle within the collar section, and covering the surface with spackle such that it becomes integral with the ceiling surface.

A kit for retrofitting an existing trimmed light fixture may include a device for retrofitting an existing trimmed recessed lighting fixture for installation of a trimless recessed light fixture, comprising: a collar section configured to be received within an opening of a housing of the existing trimmed recessed lighting fixture installed above a ceiling surface, the collar section including a proximal section configured to be fitted the opening of the housing to secure the collar section therein; and a surface including an opening through which the collar section is receivable, the surface being configured to be joined to the ceiling surface and covered to become integral with the ceiling surface; and fastener members for joining the surface to the ceiling surface.

The above and other aspects, features and advantages of the present invention will become apparent from the following description read in conjunction with the accompanying drawings, in which like reference numerals designate the same elements.

BRIEF DESCRIPTION OF THE DRAWINGS

A further understanding of the present invention can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENTS

As required, a detailed illustrative embodiment of the present disclosure is disclosed herein. However, techniques, systems, compositions and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present disclosure.

A first embodiment of a trimless recessed lighting system 100 in accordance with the present disclosure is now described with reference to FIGS. 3A-5.

The trimless recessed lighting system 100 may include a standard housing 102, which is mounted above a ceiling surface. As described herein, a proximal end P is the end of the system 100 that is hidden above the ceiling surface and a distal end D is the end of the system 100 that is exposed or substantially flush with the ceiling surface when installed. That is, the housing 102 is at the proximal end P of the system 100 and an exposed or exterior portion 104 is at the distal end D of the system 100. The term proximal shall refer to a portion that is closer to the proximal end P and the term distal shall refer to a portion that is farther from the proximal end P and close to the surface of the ceiling when installed.

Figure 1:
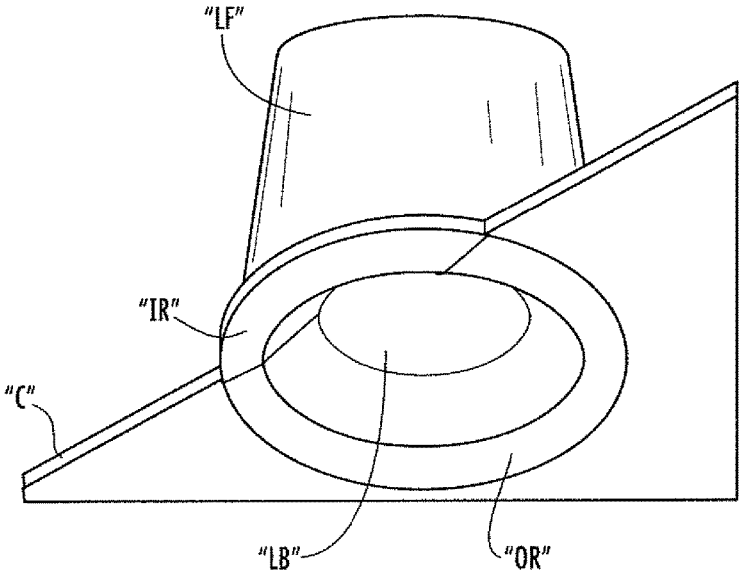
FIG. 1 PRIOR ART
FIG. 1 is a perspective view of a prior art recessed lighting fixture including a trim.
Figure 2:
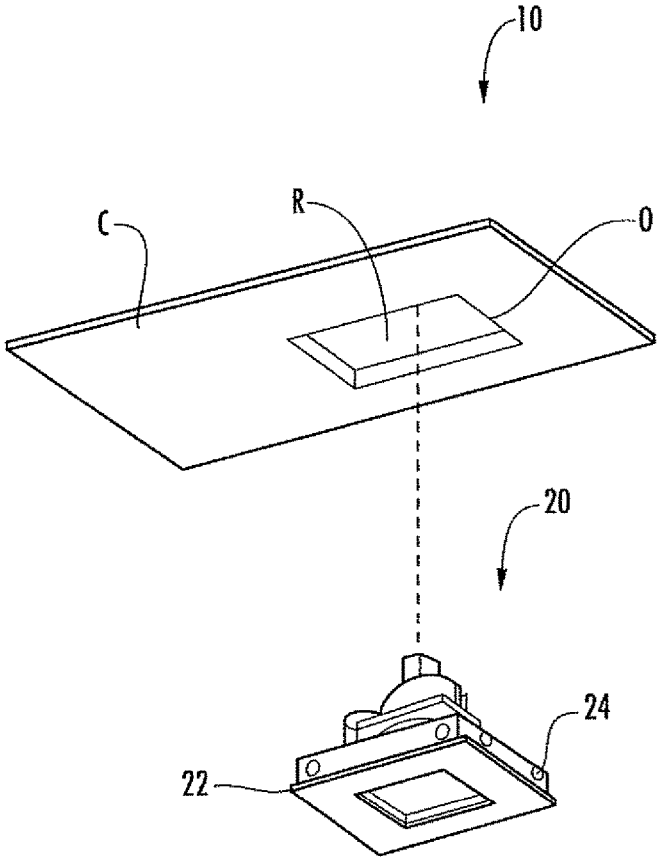
FIG. 2 PRIOR ART
FIG. 2 is a perspective view of a prior art trimless recessed lighting fixture.
Figure 3A:
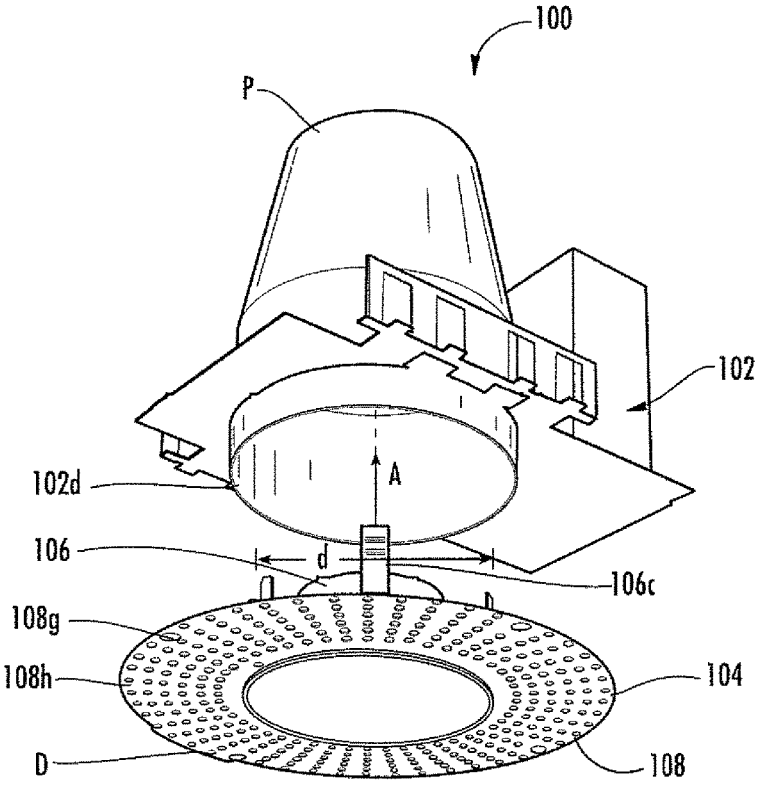
FIG. 3A is a partially exploded perspective view of a trimless recessed lighting fixture in accordance with the present disclosure.
Figure 3B:
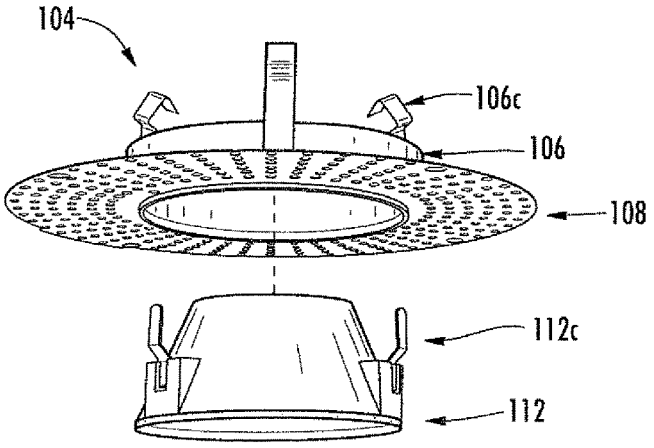
FIG. 3B is an exploded view of an exterior portion of the trimless recessed lighting fixture of FIG. 3A.
Figure 4A:
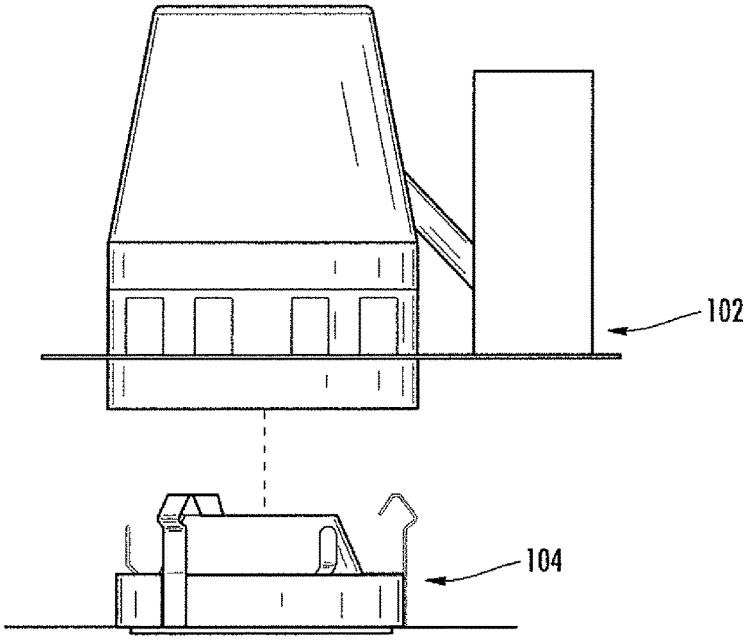
FIG. 4A is a front view of the trimless recessed lighting fixture as shown in FIG. 3A.
Figure 4B:
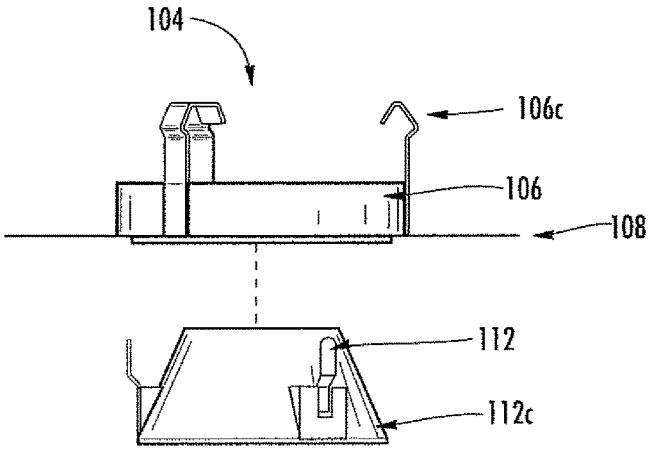
FIG. 4B is a front view of the trimless recessed lighting fixture as shown in FIG. 3B.
Figure 5:
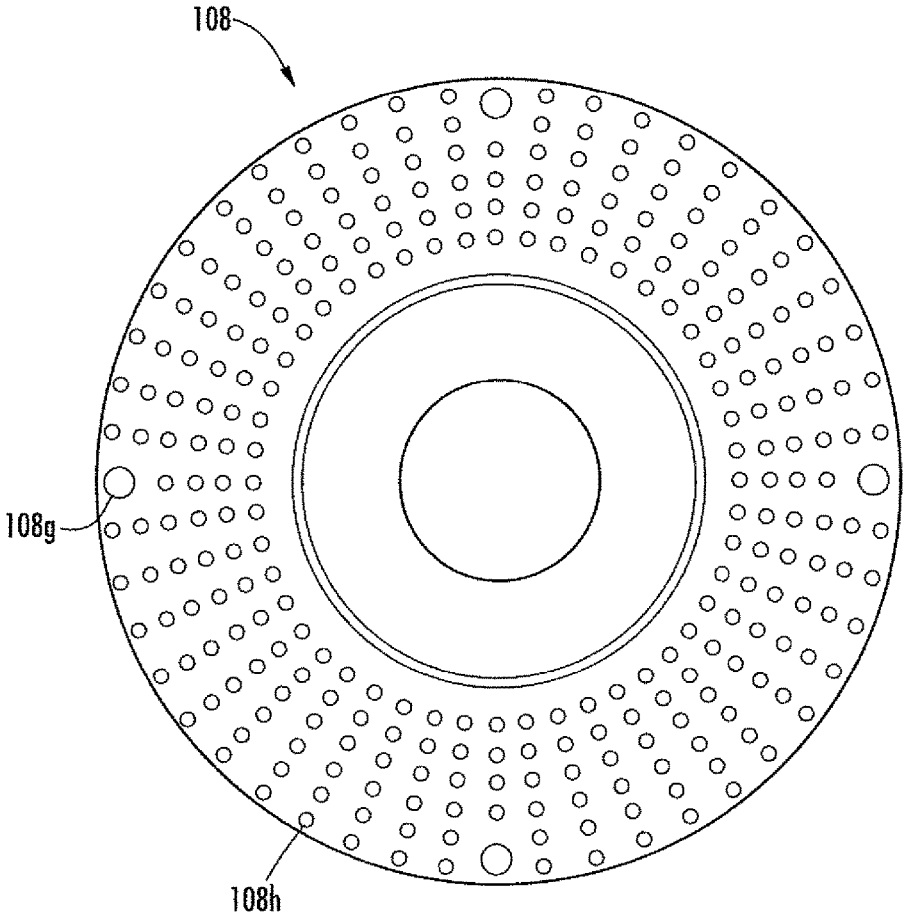
FIG. 5 is a bottom view of the trimless recessed lighting fixture of FIG. 3A.

The housing 102 may be of a conventional type which may be substantially similar and interchangeable with a housing that may already be installed in a homeowner's house. The housing 102 may be of a standard dimension and similar to the light fixture LF shown in FIG. 1, and may include a cylindrical section that has a diameter d, e.g., 4 inches. In the case where a trimmed recessed lighting is already installed in a ceiling, the trim OR may be removed thereby exposing an opening 102*d* at a distal end of the housing 102 through the ceiling.

An exterior portion 104 of the system 100 may include a collar section 106, a surface 108, and a baffle 112. The collar section 106 may include one or more clips 106*c* that may be capable of small deformations or deflections such that they may be frictionally received and secured within the opening 102*d* of the housing 102. For example, there may be three equally spaced apart clips 106*c* around the circumference of the collar section 106. The clips 106*c* may engage the opening 102*d* in such a way as to approximate the opening 102*d* regardless of its diameter within a predetermined range. Typically, the opening 102*d* of a standard housing 102 has a 4-inch diameter. The collar section 106 may have an opening extending therethrough and may have a cylindrical or a conical shape. A surface 108 may be disposed around a distal end of the perimeter or circumference of the collar section 106. The surface 108 may have a diameter that is about twice that of the diameter of the opening 102*d* of the housing 102. The surface may have a diameter that is roughly twice that of the diameter of the distal end of the collar section 106, and may have a thickness that is relatively small such that when covered by primer and/or paint the surface will become integrated with the ceiling surface creating an appearance of a trimless fixture. The surface 108 may include a plurality of openings including, for example, apertures 108*g* which may each receive a fastener (e.g., a screw) therethrough for securing the surface to the ceiling. In addition, the surface 108 may include a plurality of openings 108*h* which may serve to reduce weight and/or to receive spackle and/or paint when the surface 108 is coated (e.g., spackled and/or painted over) such that the surface 108 become integral with the ceiling surface.

The relative thinness of the surface 108 does not add to the thickness of the ceiling in any substantial or noticeable way, particular when painted over to conceal the surface 108. The collar section 106 may further be sized and shaped to securely receive a baffle 112 therein. The baffle 112 may have a generally conical shape, and may facilitate directing light. Clips 112*c* may extend proximally from the distal end of the baffle 112, and may facilitate securing the baffle 112 within the collar 106.

A method of installation of the system 100 may include securing the surface 108 to the preexisting housing 102 by fitting the clips 106*c* within the opening 102*d* of the housing 102, securing the baffle 112 within the surface 108, and joining the surface 108 to the ceiling by screwing the surface 108 to the ceiling and covering it with spackle and/or paint.

Another embodiment of a trimless lighting fixture will now be described with reference to FIGS. 6-7.

Figure 6:
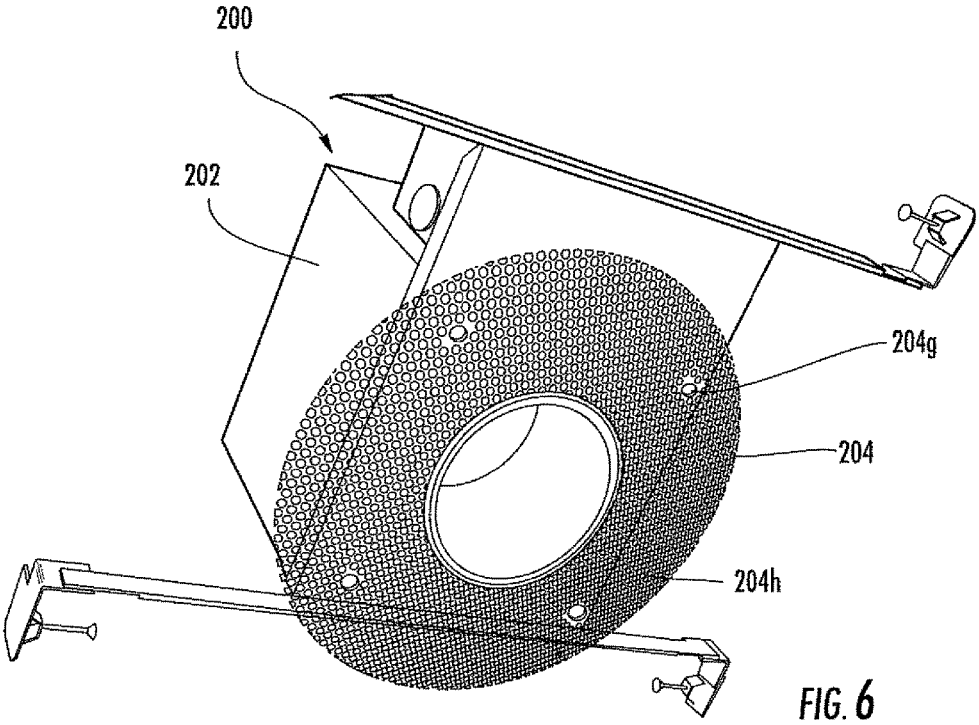
FIG. 6 is a perspective view of a trimless recessed lighting fixture in accordance with the present disclosure.
Figure 7:
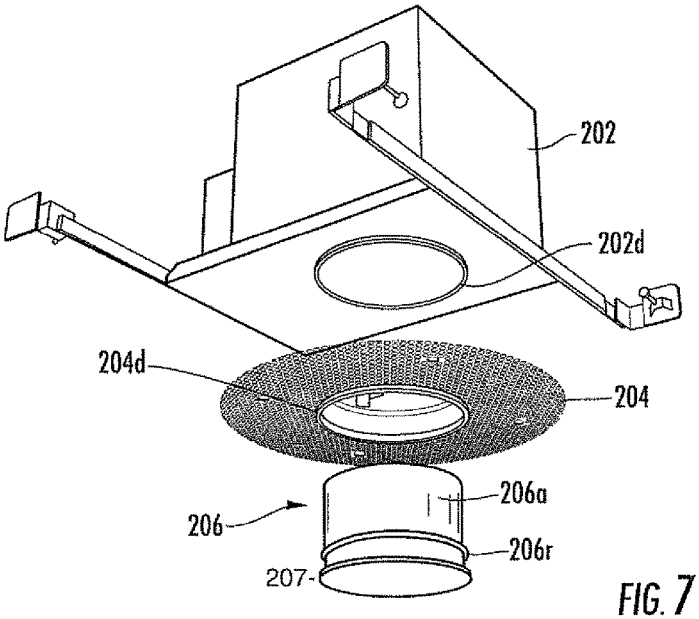
FIG. 7 is an exploded perspective view of the trimless recessed lighting fixture of FIG. 6.
Figure 7A:
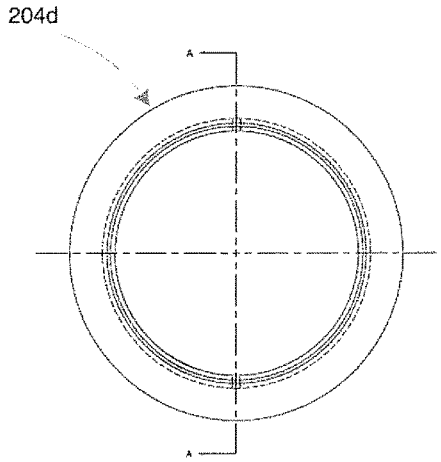
FIG. 7A is a bottom view of a collar in accordance with the present disclosure.
Figure 7B:
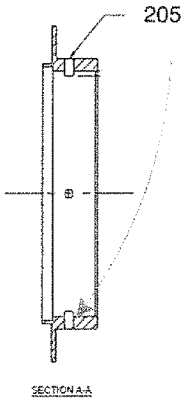
FIG. 7B is a cross-sectional view of the collar of FIG. 7A taken along section line A-A.
Figure 7C:
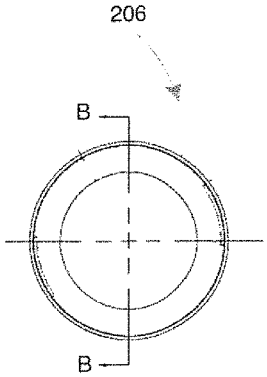
FIG. 7C is a bottom view of a baffle in accordance with the present disclosure.
Figure 7D:
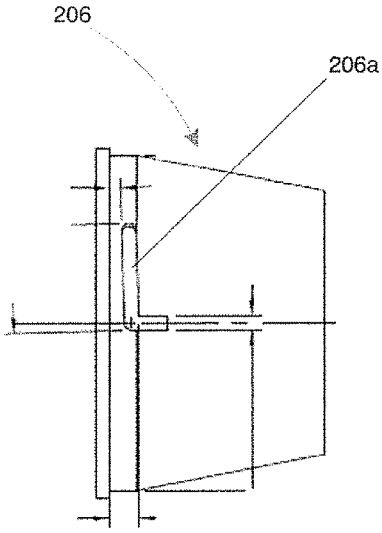
FIG. 7D is a side view of the baffle of FIG. 7C.
Figure 7E:
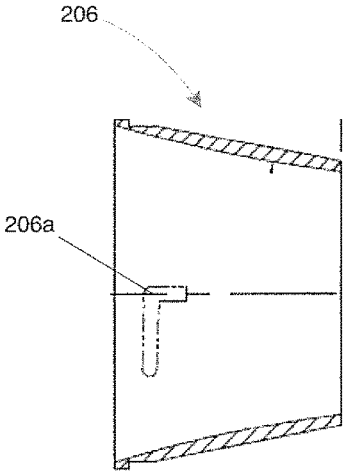
FIG. 7E is a cross-sectional view of the baffle of FIG. 7C taken along section line B-B.

As shown in FIG. 6, a traditional housing 202 similar to housing 102 described above may be installed or mounted above the surface of a ceiling. During use, the housing 202 shown in FIGS. 6-7 may be substituted with an already installed standard housing. A surface 204 may have a generally circular shape and may be positioned flush against the ceiling and over an opening 202*d* of the housing 202. The surface 204 serves to hide the opening of the ceiling and is connected to a collar 204*d* that has an opening that may be fitted within the opening 202*d*. The collar 204*d* may be secured (e.g., welded) to the surface 204. The surface 204 may include apertures 204*h* to reduce weight and to provide a surface conducive to receiving spackle and/or paint such that when painted over, the surface 204 becomes integral with the ceiling. Further, the surface 204 may include holes 204*g* that are each configured to receive a fastener such as a screw therethrough for securing the surface 204 to the ceiling. The collar 204*d* of the surface 204 may extend a distance proximal, above the ceiling surface into the housing 202 through the opening 202*d* of the housing 202. A baffle 206 may include an exterior surface 206*a* around which a gasket ring 206*r* is fitted for securing the baffle 206 within the opening 202*d* of the housing 202.

An insert 207 for facilitating desired direction of the light may be fitted within the baffle 206, and may also obscure from view the interior of the housing 202 and to direct light from a bulb or other light emitting object (e.g., an LED) from inside the housing 202. The baffle 206 may have a generally cylindrical shape, and may include a ring 206*r* that may be elastic and may be formed from a rubber like material that may facilitate frictionally securing the baffle 206 within the collar 204*d* of the surface 204. The baffle 206 may also be sized and shaped such that when it is placed within the collar 204*d* of the surface 204 and within the opening 202*d* of the housing 202 that the baffle frictionally engages both the openings 204*d* surface 204 and the opening 202*d* of the housing 202 to secure the surface 204 relative to the housing 202.

As shown in FIGS. 7A-7E, the collar 204*d* and the baffle 206 may include locking mechanisms to secure the two together. In particular, the collar 204*d* shown separated from the surface 204 may include locking pins 205 that are configured to engage at least one groove or channel 206 which may be formed on opposing sides of a surface of the baffle 206, thereby releasably securing or locking the collar 204*d* and the baffle 206 to each another.

A method of installation of the system 100 may include securing the surface 204 to the preexisting housing 102 by fitting collar 204*d* within the opening 102*d* of the housing 102, which may be facilitated by placing the baffle 206 through the openings of the surface 204 and the housing 202. Thereafter, insert 207 may be secured within the baffle 206 and may for cosmetic reasons have a color that matches the color of the ceiling.

Figure 8:
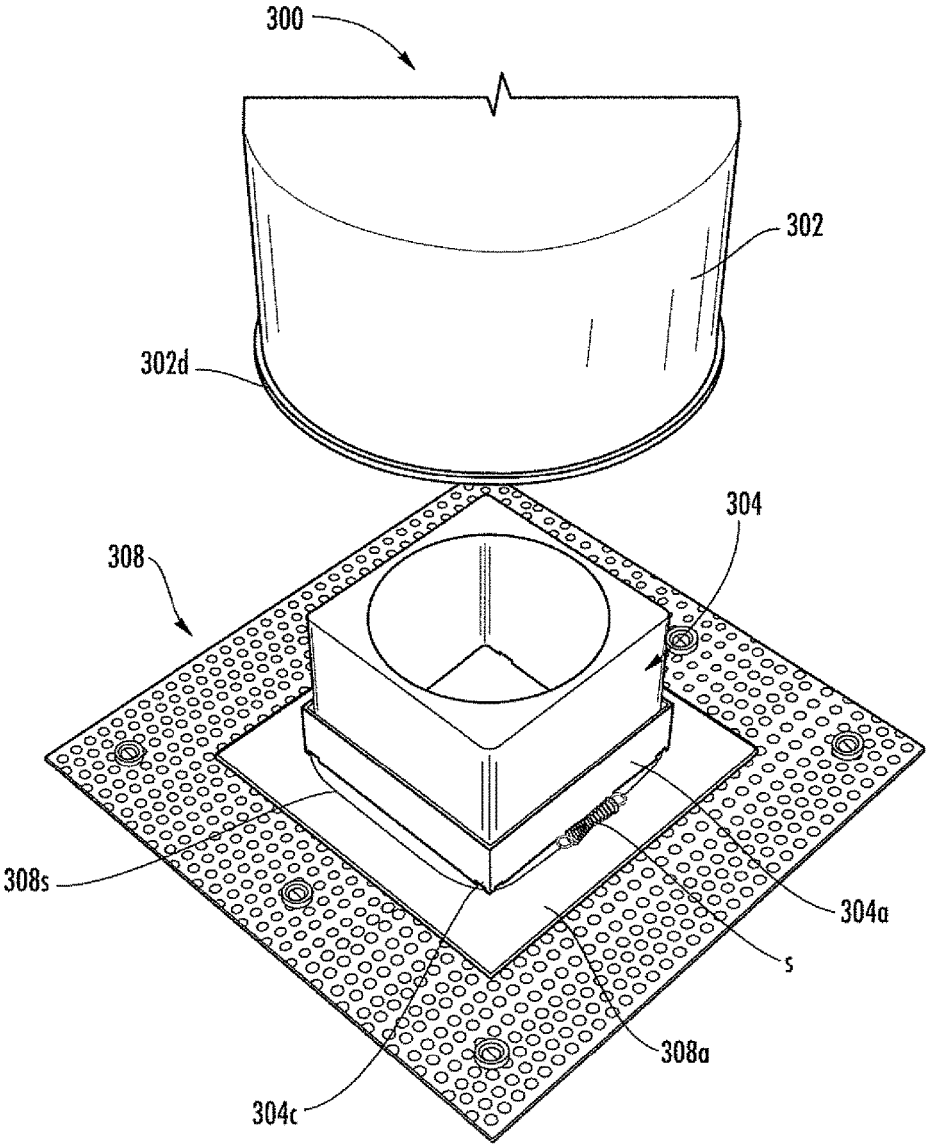
FIG. 8 is a top view of a trimless lighting fixture in accordance with the present disclosure shown separated from a housing.
Figure 9:
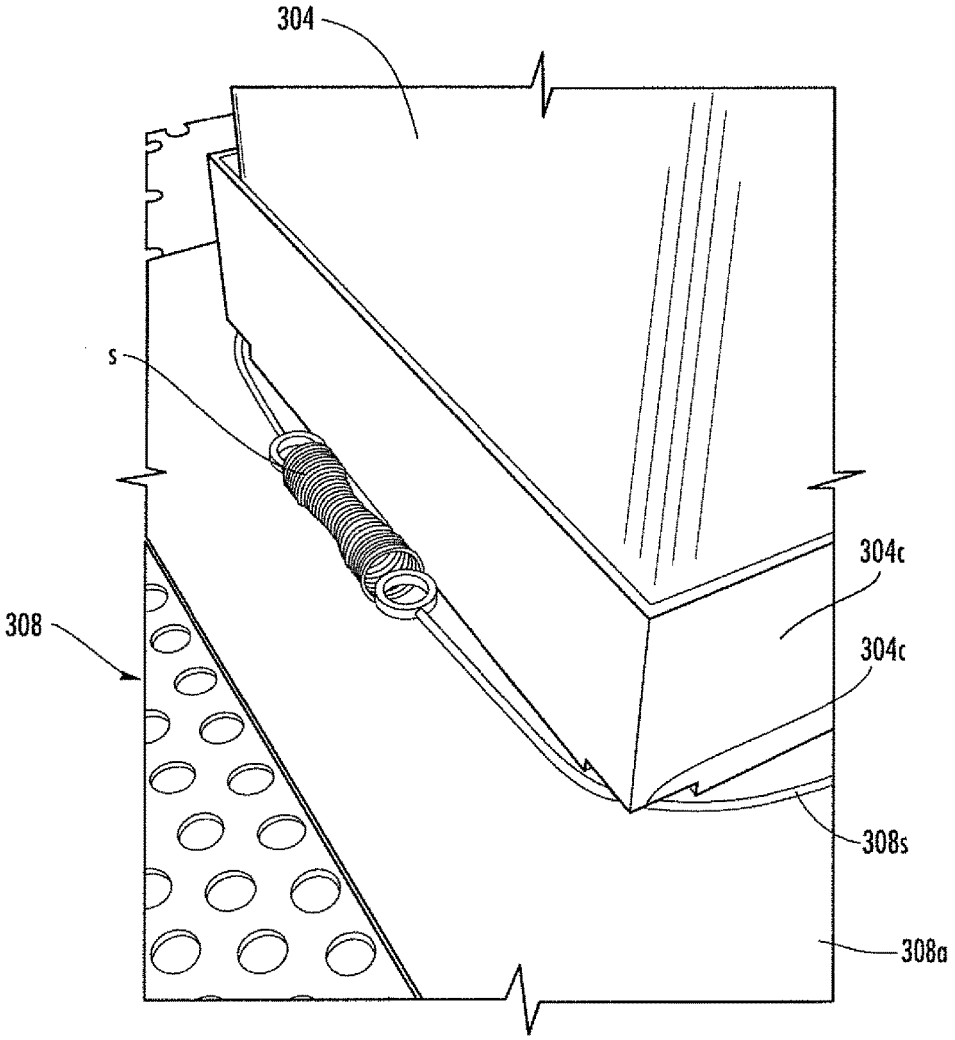
FIG. 9 is an enlarged view of a portion of the trimless lighting fixture of FIG. 8.

A further embodiment of a light fixture system 300 is now described in FIGS. 8-9.

The light fixture 300 may include a standard housing 302 similar to that described above with reference to housings 102 and 202. While the housing 302 may have a circular opening 302*d* at a distal end thereof, the housing 302 may receive a collar section 304, which may also function as a baffle, within its opening 302*d* to give the appearance of a square or rectangular light fixture when viewed from below the ceiling surface. The collar section 304 may be snuggly received, that is frictionally secured by an interference fit, within the opening 302*d* of the housing 302. Attached or secured to a distal end of the lower section 304 may be a surface 308 which is similar to the surfaces 108 and 208 described above. The surface 308 may have a square or rectangular shape. The distal section 304*a* may include receptacles 304*c* at corners thereof for the reception of a string 308*s* therein. The string 308*s* may have its ends joined by tensioned string that includes the string 308*s* and a spring S that is secured at ends thereof such that when the string 308*s* is secured within the receptacles 304*c*, the string 308*s* is tensioned toward a smaller size.

A method of installation may include seating the baffle 304 within the distal section 304*a* and when the string 308*s* is received within the corners 304*c*, the string 308*s* frictionally engages the baffle 304 thereby inhibiting or preventing removal of the baffle 304 from the distal section 304*a*.

Figure 10:
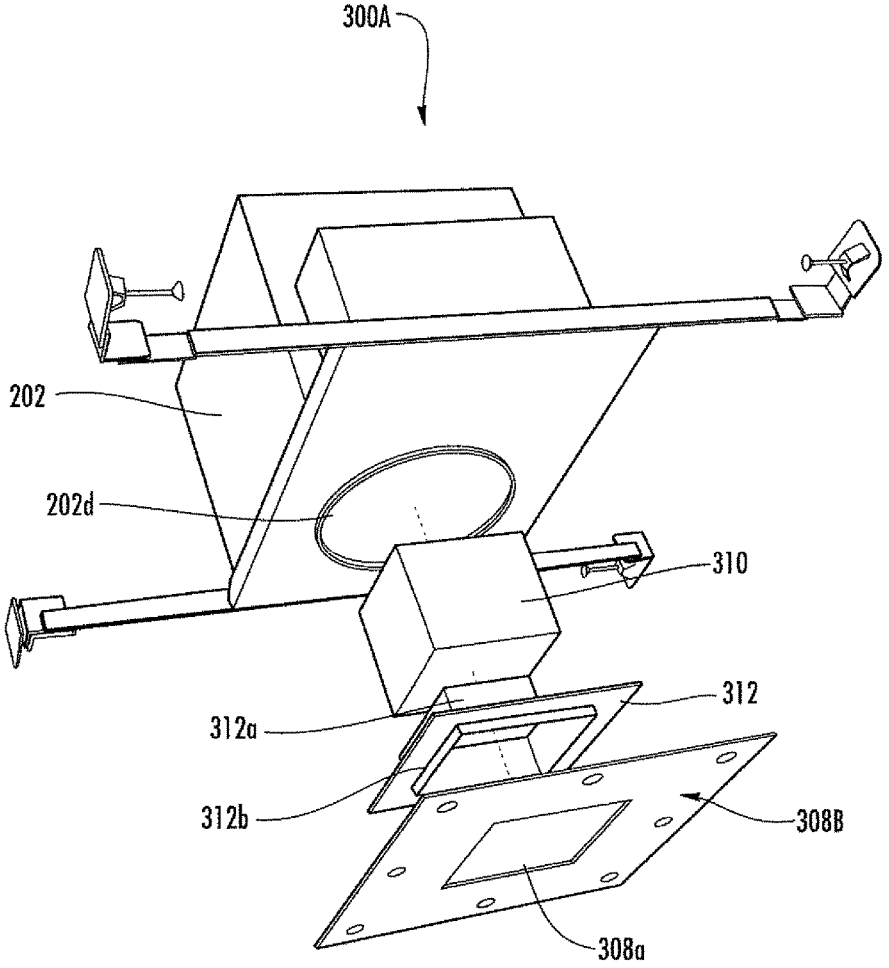
FIG. 10 is an exploded view of a trimless lighting fixture in accordance with the present disclosure.

A further embodiment of a light fixture system 300A is now described with reference to FIG. 10.

The light fixture system 300A may include the standard housing 202 discussed above, and may further include a square or rectangular baffle or collar section 310 which may be friction fitted within the opening 202*d* of the housing 202. The system 300A may also include a surface 308B that is similar to the surface 308 except in how it is coupled to the remainder of the system 300A. In particular, a connecting member 312, which may be a hollow rectangular prism having a hole extending lengthwise therethrough, may include an upper portion 312*a* that is configured to be fitted within the distal opening of the connecting member 312. The connecting member 312 may further include a lower lip 312*b* that is configured to frictionally fit within opening 308*a* of the surface 308 in a friction fit secured connection.

The light fixture system 300A may include standard housing 202 including opening 202*d* in which a baffle 310, which may have a rectangular prism shape including a through-hole extending therethrough may be frictionally fit and secured. A connecting piece 312 may include an upper section 312*a* which may be frictionally fit within the distal opening of the baffle 310. The connecting piece 312 may include a lower lip 312*b* that extends distally from the distal surface of the connecting piece 312. An opening 308*o* of the surface 308 may securely receive the lip therein such that the surface 308 is held in place relative to the connecting piece 312. The baffle 310, the connecting piece 312 and the surface 308 may have rectangular or square shapes even though the standard housing 202 may have an opening 202*d* that is circular in shape.

A method of installation of the system 300A may include fitting the baffle 310 within the opening 202*d* and using the connecting piece 312 to secure the baffle 310 to the surface 308B.

A kit may include at least one of each of the above disclosed light fixture systems, as well as, fastener attachment members such as nails and/or screws, and/or ceiling covering material such as paint and/or spackle.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the invention in any manner.

In the claims, means or step-plus-function clauses are intended to cover the structures described or suggested herein as performing the recited function and not only structural equivalents but also equivalent structures.

Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A device for retrofitting an existing trimmed recessed lighting fixture for installation of a trimless recessed light fixture, comprising:

a collar section configured to be received within an opening of a housing of the existing trimmed recessed lighting fixture installed above a ceiling, the collar section including a proximal section configured to be fitted within the opening of the housing;

a surface element being secured the collar section, the surface element being configured to lie flush against the ceiling and to be joined integrally to the ceiling; and a baffle being releasably lockable to the collar section;

a connecting member that is configured to frictionally engage substantially an inner perimeter of the baffle in its entirety and to also frictionally engage substantially an inner perimeter of an opening of the surface element in its entirety such that the baffle is secured to the surface element;

wherein the collar section has a shape corresponding to the shape of the opening of the housing and the opening of the surface element such that when the collar section is fitted within both openings, the surface element is secured relative to the housing; and wherein the surface element includes at least one hole configured to receive a fastener to secure element the surface to the ceiling; and wherein the surface element is configured to be coated with a compound such that it becomes integral with the ceiling.

2. The lighting fixture of claim 1, wherein the collar section is frictionally fitted within the opening of the housing.

3. The lighting fixture of claim 1, wherein the collar section includes one or more clips that are configured to engage the opening of the housing.

4. The lighting fixture of claim 1, wherein the baffle is receivable within the opening of the surface element and within the opening of the housing.

5. The lighting fixture of claim 1, wherein the opening of the housing is circular and the surface element has a rectangular shape.

6. The lighting fixture of claim 1, wherein the collar section includes an upper portion and a lower portion, the upper portion being configured to be seated within the lower portion and secured thereto by a tensioned string.

7. The lighting fixture of claim 1, further comprising the connecting member that includes an upper lip configured to be frictionally secured within the collar section and a lower section configured to be frictionally secured within the opening of the surface element.

8. A method for retrofitting an existing trimmed light fixture including a housing mounted above a ceiling, comprising:

frictionally fitting a collar section within an opening of the housing;

securing a surface element to the collar section;

fitting a baffle within the collar section;

providing a connecting member and frictionally securing a first end of the connecting member within an interior space of baffle and an interior space of the surface element, the connecting member being frictionally secured substantially along an entire perimeter of the interior space of the surface element and being frictionally secured substantially along an entire perimeter of the interior space of the baffle; and covering the surface element with spackle such that it becomes integral with the ceiling.

9. A kit for retrofitting an existing trimmed light fixture comprising:

a device for retrofitting an existing trimmed recessed lighting fixture for installation of a trimless recessed light fixture, comprising:

a collar section configured to be received within an opening of a housing of the existing trimmed recessed lighting fixture installed above a ceiling, the collar section including a proximal section configured to be fitted within the opening of the housing;

a surface element being secured the collar section, the surface element being configured to lie flush against the ceiling and to be joined integrally to the ceiling; and a baffle being releasably lockable to the collar section;

a connecting member that is configured to frictionally engage substantially an inner perimeter of the baffle in its entirety and to also frictionally engage substantially an inner perimeter of an opening of the surface element in its entirety such that the baffle is secured to the surface element; and fastener members for joining the surface element to the ceiling.

* * * * *